US005246038A

United States Patent [19]

Corain

[11] Patent Number: 5,246,038

[45] Date of Patent: Sep. 21, 1993

[54] TUCKED SELVEDGE FORMING DEVICE

[75] Inventor: Luciano Corain, Vicenza, Italy

[73] Assignee: Nuovopignone-Industrie Meccaniche e Fonderia SpA, Florence, Italy

[21] Appl. No.: 843,630

[22] Filed: Feb. 28, 1992

[30] Foreign Application Priority Data

Mar. 8, 1991 [IT] Italy ..... 000637 A/91

[51] Int. Cl.[5] ..... D03D 47/48

[52] U.S. Cl. ..... 139/434

[58] Field of Search ..... 139/434, 25, 26

[56] References Cited

U.S. PATENT DOCUMENTS 4,142,559 3/1979 Sbabo ..... 139/434

4,600,039 7/1986 Gorain ..... 139/434

*Primary Examiner*—Andrew M. Falik

*Attorney, Agent, or Firm*—Morgan & Finnegan

[57] ABSTRACT

A mechanism for selecting the movement of the movable members of a tucked selvedge forming device. The device is suitable for operation on terry looms which comprise a feeler pivoted at one end to the device casing and cooperates via a spring with one of a plurality of cams for driving operating levers. This arrangement causes a bridge frame rigid with it to rock a position in which the bridge of the frame is interacting with stop teeth of the operating levers to a position in which there is no longer interaction and in which a metal armature rigid with the feeler rests against an electromagnet supported by the device casing.

2 Claims, 3 Drawing Sheets

TUCKED SELVEDGE FORMING DEVICE

BACKGROUND OF THE INVENTION

1. Field of the Invention

This invention relates to a new mechanism for selecting the movement of the movable members of a tucked selvedge forming device, particularly suitable for terry looms, which by eliminating any movement by magnetic action and consequently any danger of sticking due to external causes such as dust etc., enables high operating speeds to be attained as required by modern looms, and results in considerable energy and hence cost saving. More specifically, the invention relates to an improvement in the previous U.S. Pat. No. 4,600,039 of Jul. 15, 1986 of the same applicant.

2. Description of the Related Art

According to this patent, a tucked selvedge forming device comprises a movable member for grasping and cutting the weft ends and driven with translational movement in order to grasp said weft ends and cut them to size, and with rotational movement to wrap said weft ends about a second hook-shaped movable member for feedback which is also driven with translational and rotational movement to penetrate into the warp and drag in said weft ends, all said movements being obtained independently of each other by separate levers which, pivoted at one end on one and the same shaft and spring-biassed, are driven by corresponding drive cams also fixed onto one and the same shaft.

As a terry cloth is substantially obtained, in known manner, by firstly inserting several weft yarns, which are carried by the reed into a retracted blind beatup position located generally a few millimeters from the fell of the fabric under formation, and then beating up said already inserted weft yarns, together with a further inserted weft yarn, against said fell, and as the tucked selvedge must be formed only after this last beatup, it is apparent that the ends of the inserted weft yarns are fed back into the shed to form the selvedge only after they have been beaten up by the reed against the fell of the fabric, so excluding feedback during blind beatup. In other words, the movable members provided for the feedback of the inserted weft yarn ends into the shed have to be kept inactive or locked in their rest position until said inserted weft yarns have been beaten up by the reed against the fell of the fabric under formation.

This locking is achieved, according to the teachings of said U.S. Pat. No. 4,600,039 in that said operating levers are provided at their pivoted end with appendices or stop teeth which cooperate with a mechanism for selecting the movement of said movable member, comprising corresponding locking abutments mounted on a support arbor which is electromagnetically movable axially parallel to the pivoting shaft for said operating levers from a position, maintained by a reacting spring, in which said locking abutments engage said teeth, to a position in which they do not engage. In this manner, to achieve feedback of the weft yarns into the shed to form the selvedge and hence the full operation of all the movable members, it is necessary only to energize the electromagnet, which overcomes the action of said reaction spring to move the locking abutments on the arbor out of interference with the teeth of the operating leers.

However, said known selection mechanism suffers from a series of drawbacks, the most serious of which is the considerable mass which has to be moved by the electromagnet, which in addition to consuming a considerable amount of energy does not allow high operating speeds to be attained because of the considerable inertia in play; in addition, because of its configuration the known mechanism is subject to possible sticking due to the ever-present dust which can hinder, if not block, the movement of said arbor.

SUMMARY OF THE INVENTION

The object of the present invention is therefore to obviate the aforesaid drawbacks by providing a mechanism for selecting the movement of the movable members of a tucked selvedge forming device which is of low energy consumption and allows high operating speeds to be achieved without any danger of sticking.

This object is attained substantially in that no element is moved magnetically, an electromagnet being used only for retaining against itself, when energized, an element which has been mechanically moved into contact with it.

More specifically, said selection mechanism is in the form of a bridge frame made to rock, by one of said cams which drive the operating levers, from a position in which the bridge of the frame interacts with the stop teeth present on said operating leers to keep the relative movable members of the tucked selvedge forming device inoperative, to a position in which there is no longer interaction and in which a metal armature of the bridge rests against an electromagnet.

In this manner, said movable members remain inoperative until said electromagnet is energized which, by retaining the magnetic armature and hence the frame against itself, enables said operating levers to follow the contour of their drive cams and hence move said movable members.

Hence, the mechanism for selecting the movement of the movable members of the tucked selvedge forming device, particularly suitable for terry looms, said device comprising a movable member for grasping and cutting the weft ends and drive with translational movement in order to grasp said weft ends and cut them to size, and with rotational movement to wind said weft ends about a second hook-shaped feedback movable member which is also driven with translational and rotational movement to penetrate into the warp and drag in said weft ends, all said movements being obtained independently of each other by separate levers which, pivoted at one end on one and the same shaft, are spring-biassed and are each provided at said pivoted end with a stop tooth, are driven by corresponding drive cams also fixed onto one and the same shaft, is characterized according to the present invention by comprising a feeler pivoted at one end to the device casing and cooperating via a spring with one of said cams which drive said operating levers to cause a bridge frame rigid with it to rock from a position in which the bridge of the frame interacts with said stop teeth present on said operating levers to lock said levers in position, to a position in which there is no longer interaction and in which a metal armature rigid with the feeler rests against an electromagnet supported by said device casing.

According to a preferred embodiment of the present invention, said frame is made rigid with said feeler by an inverted U spring which has its head rigid with the frame and its two legs resting against opposite sides of a pin rigid with the feeler.

In this manner the frame undergoes a rocking movement of smaller width than the undergone by the feeler, because the frame follows the feeler movement imposed by the drive cam with a certain delay due to the necessary springing of that leg of the inverted U spring situated on the movement side; this therefore enables the dimensions of the tucked selvedge forming device to be reduced and also compensates any phase deference between the movement imposed by the contour of the drive cam and the movement actually required.

The invention is described hereinafter with reference to the accompanying drawings, which illustrate a preferred embodiment thereof given only by way of non-limiting example in that technical or constructional modifications can be made thereto without leaving the scope of the present invention.

DESCRIPTION OF THE PREFERRED EMBODIMENT

Figure 1:
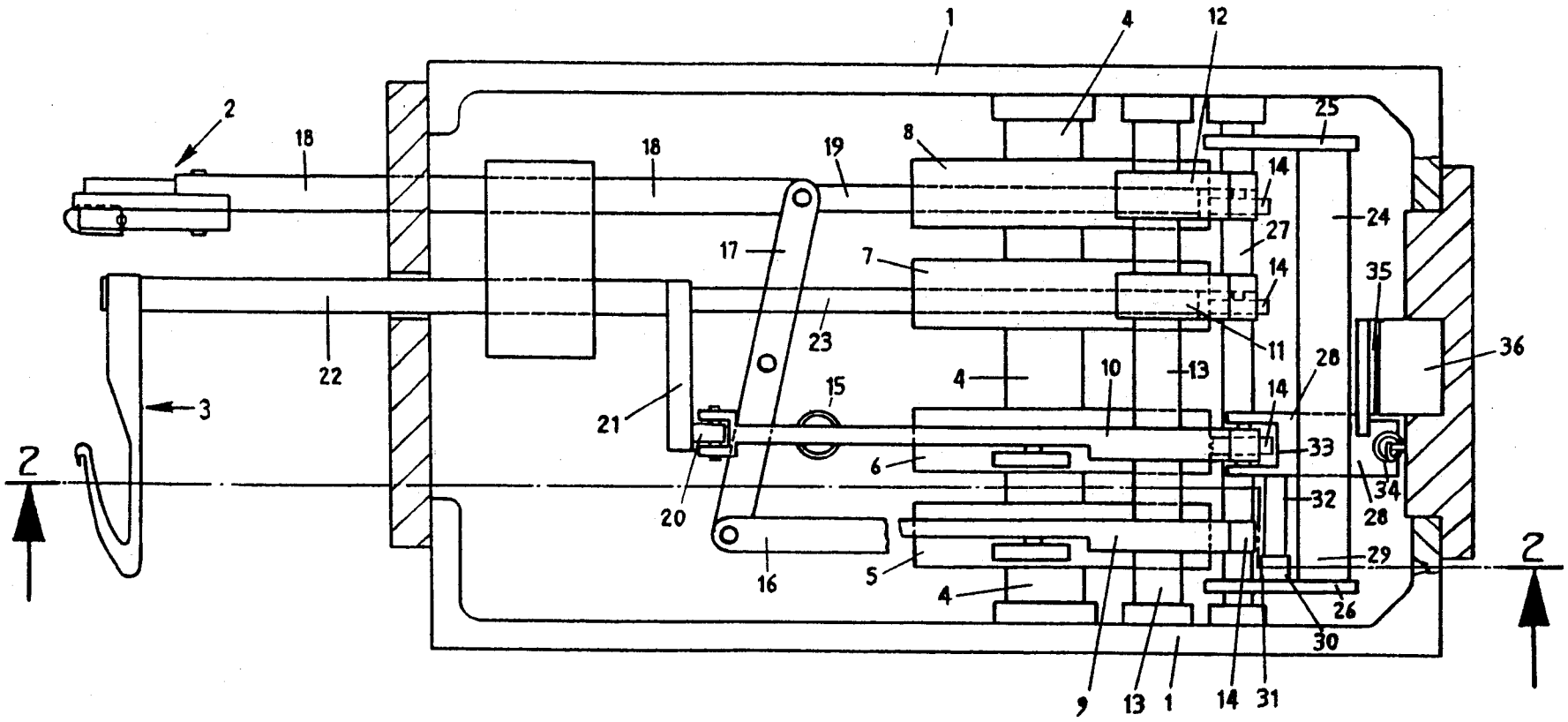
FIG. 1 is a partial section from above through a tucked selvedge forming device using a mechanism for selecting the movable member movement constructed in accordance with the invention.

In the figures the reference numeral 1 indicates the casing of the tucked selvedge forming device, which houses and supports the levers driving the grasping and cutting movable member 2 and the hook-shaped feedback movable member 3. More specifically, a shaft 4 rotatably supported by said casing 1 and driven by the loom drive shaft, not shown in the figures, carries fixed on it the drive cams 5, 6, 7 and 8 which drive the operating levers 9, 10, 11 and 12 respectively, which are pivoted at one end on one and the same shaft 13, each comprising on said end a stop tooth 14 and being maintained in contact with the respective drive cam by a spring 15. By way of the levers 16, 17 and 18 the operating lever 9 causes the grasping and cutting movable member 2 to rotate, whereas its translation is determined by the action of the operating lever 12 via the rod 19. Again, by way of the eccentric lever system 20, 21 and 22 the operating lever 10 causes the retracting hook-shaped movable member 3 to rotate, whereas the translation of said member 3 is determined by the operating lever 11 via the rods 23 and 22. Said stop teeth 14 of the operating levers 9–12 cooperate with the bridge 24 of a bridge frame, the two shoulders 25 and 26 of which are pivoted on the shaft 27 supported by said casing 1. Said frame is made rigid with a feeler 28 by an inverted U spring 29, the head of which is fixed to the frame and the two legs 30 and 31 of which rest against opposite sides of a pin 32 rigid with the feeler 28. Said feeler 28 is pivoted on said shaft 27 and is provided with a roller 33 kept pressed by a spring 34 against the contour of the drive cam 6, and a meal armature 35 cooperating with an electromagnet 36 supported by said casing 1.

Figure 2:
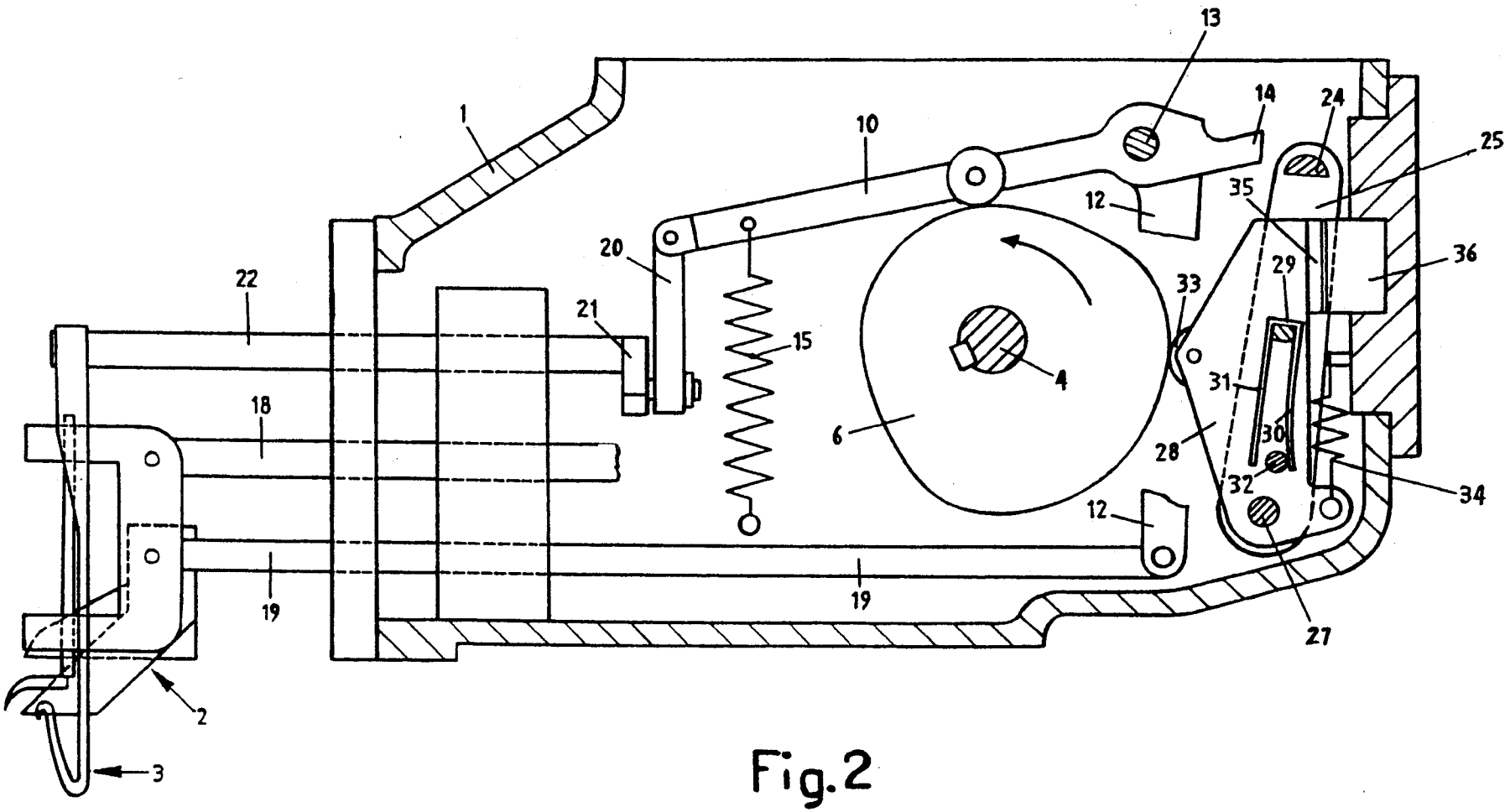
FIG. 2 is a partial front section on the line AA of FIG. 1.
Figure 3:
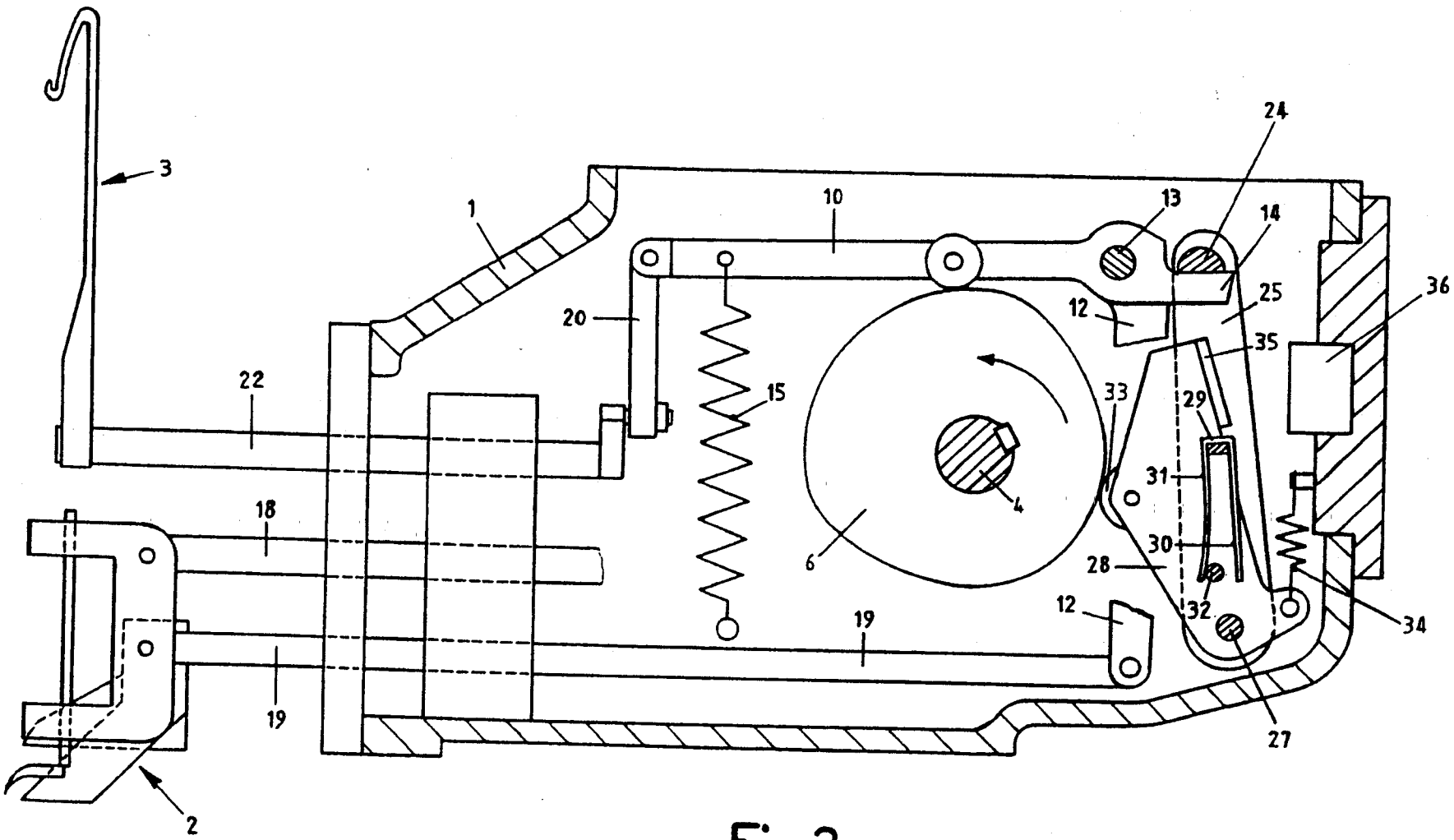
FIG. 3 is a view analogous to that of FIG. 2 showing the selection mechanism in its interaction position.

Finally, FIGS. 2 and 3 show the feeler-frame assembly in the two end positions of its rocking movement, ie in the position in which there is no interaction between the frame bridge 24 and the stop teeth 14 of the operating levers 9–12 and with the armature 35 resting against the electromagnet 36, and in the position in which said interaction exists.

I claim:

1. A tucked selvedge forming device for a fabric having warp and weft ends, the device having a casing and comprising a rotatably and translatably movable member for grasping and cutting to size the weft ends, a translatable and rotatable hook-shaped feedback movable member about which the grasped and cut weft ends are wound, a shaft, separate levers each pivoted at one end on said shaft, said levers establishing said movable and hook-shaped members' translation and rotation movements independently of each other, spring biassing means for each of said levers provided at said respective pivoted ends thereof, a plurality of stop teeth at said pivoted lever ends, each tooth being individual to a respective one of said levers, drive cams secured to said shaft for driving respective levers, a feeler pivoted at one end to the device casing and bearing against one of said cams which drive said levers, feeler biassing means for engaging said feeler with said associated cam, a bridge frame rigid with said feeler to rock from a position in which said bridge frame interacts with said stop tooth of said respective operating lever to lock said levers in position, to a position in which said interaction is discontinued, an armature rigid with said feeler, and an electromagnet supported by the device casing and against which said armature and said feeler rest in order to enable said bridge frame to rock to said two positions as said electromagnet is de-energized and energized.

2. The tucked selvedge forming device as claimed in claim 1 in which said bridge frame, rigid with said feeler further comprises a pin rigid with the feeler, and an inverted U spring which has its head rigid with the frame and its two legs selectively resting against opposite sides of said pin.

* * * * *